US007104225B2

(12) United States Patent
Bontaz

(10) Patent No.: US 7,104,225 B2
(45) Date of Patent: Sep. 12, 2006

(54) PISTON COOLING NOZZLE WITH SMALL DISTANCE BETWEEN AXES

(75) Inventor: Yves Bontaz, Marnaz (FR)

(73) Assignee: Bontaz Centre, Marnaz (FR)

( * ) Notice: Subject to any disclaimer, the term of this patent is extended or adjusted under 35 U.S.C. 154(b) by 22 days.

(21) Appl. No.: 10/980,500

(22) Filed: Nov. 3, 2004

(65) Prior Publication Data

US 2005/0098122 A1 May 12, 2005

(30) Foreign Application Priority Data

Nov. 4, 2003 (FR) ..... 03 13248

(51) Int. Cl.
*F01P 1/04* (2006.01)

(52) U.S. Cl. ..... 123/41.35

(58) Field of Classification Search ..... 123/41.35
See application file for complete search history.

(56) References Cited

U.S. PATENT DOCUMENTS 4,995,346 A 2/1991 Hudson, Jr.

FOREIGN PATENT DOCUMENTS

DE 29 38 431 A 3/1981
EP 0 682 175 A 11/1995

*Primary Examiner*—Noah P. Kamen
(74) *Attorney, Agent, or Firm*—RatnerPrestia

(57) ABSTRACT

According to the invention, an internal combustion engine piston cooling nozzle comprises a nozzle body, a transverse fixing plate and screwing means such as a fixing screw offset laterally at a distance between axes. The nozzle body comprises an axial bore containing valve means and a transverse bore receiving a cooling fluid outlet duct. The peripheral wall is thick around the transverse bore. The diametrally opposite portion of the peripheral wall is thinner because of the presence of an external recess facing the fixing screw. Thus the fixing screw may be moved closer, by reducing the distance between axes, which reduces the overall size of the cooling nozzle.

5 Claims, 2 Drawing Sheets

PISTON COOLING NOZZLE WITH SMALL DISTANCE BETWEEN AXES

TECHNICAL FIELD OF THE INVENTION

The present invention relates to internal combustion engine piston cooling nozzles used to spray a cooling fluid such as oil onto the back of the piston, i.e. the piston face outside the combustion chamber.

DESCRIPTION OF THE PRIOR ART

The piston cooling nozzles usually employed are separate parts fixed to the engine block and communicating with a cooling fluid feed orifice. The position of the nozzle must be determined precisely to determine precisely the impact of the jet of cooling fluid on the piston base.

Internal combustion engines piston cooling nozzles are known in the art that comprise a nozzle body having a generally cylindrical peripheral wall around an axial bore containing valve means. The peripheral wall has a transverse bore through it communicating with the axial bore and connected to a cooling fluid outlet duct in the form of a tube. The nozzle body has a cylindrical portion conformed to be inserted into a fluid feed orifice of the engine cylinder block.

A first solution for fixing the nozzle to the engine cylinder block, described in the document EP 0 682 175 A1, consists in providing a nozzle having a coaxial valve screw that screws into a tapped end portion of the fluid feed pipe. An attached transverse plate prevents the nozzle rotating.

A second solution for fixing the nozzle to the engine cylinder block usually employed, described in the documents DE 29 38 431 A1 or U.S. Pat. No. 4,995,346, consists in providing a transverse fixing plate including a first hole into which the nozzle body is fixed, and a laterally offset second hole facing the transverse bore through which passes a screw for fixing the nozzle to the engine cylinder block.

This second solution is simpler to implement but has the drawback of an overall size that is sometimes excessive.

The peripheral wall of the nozzle body must be thick enough for the axial bore to retain the cooling fluid outlet duct effectively.

The diameter of the fixing screw must be sufficient to assure sufficient clamping of the fixing plate to the engine cylinder block, preventing all risk of separation or vibration.

The above two constraints make it obligatory to retain a relatively large distance between the axis of the nozzle body and the axis of the fixing screw. This leads to the transverse fixing plate being very large.

There is a requirement to reduce the size of the transverse fixing plate and the overall size of the piston cooling nozzle in order in particular to enable their use in engines that leave little room for positioning the piston cooling nozzle.

SUMMARY OF THE INVENTION

The problem addressed by the present invention is therefore that of designing a new piston cooling nozzle structure that is fixed by means of a small transverse fixing plate with a small distance between the axis of the fixing screw and the axis of the nozzle body.

The object is to enable such nozzles to be fitted to engines having little room for fixing the cooling nozzle.

At the same time, the invention aims to assure correct operation and reliability of the piston cooling nozzle, and in particular correct retention of the cooling fluid outlet duct and the nozzle as a whole.

To achieve the above and other objects, the invention proposes an internal combustion engine piston cooling nozzle comprising:

- a nozzle body with a peripheral wall around an axial bore containing valve means, a transverse bore communicating with the axial bore passing through the peripheral wall and being connected to a cooling fluid outlet duct, the nozzle body having a cylindrical inlet portion conformed to be inserted into a fluid feed orifice of the engine cylinder block,
- a transverse fixing plate having a first hole into which the nozzle body is fixed and a laterally offset second hole opposite the transverse bore for a screw for fixing the nozzle to the engine cylinder block to pass through;

according to the invention:

- at least around the transverse bore, the peripheral wall is thick, its thickness T being greater than or equal to the diameter of the transverse bore,
- the portion of the peripheral wall diametrally opposite the transverse bore is thinner because of the presence of an external recess facing the second hole in the transverse fixing plate.

The duct is retained effectively and satisfactorily thanks to the sufficient thickness of the peripheral wall in the area retaining the fluid outlet duct.

At the same time, the external recess in the diametrally opposite portion of the peripheral wall enables the axis of the nozzle body and the axis of the fixing screw to be moved closer together whilst allowing operation of the fixing screw by a clamping tool such as a robot arm end.

Another advantage is that the external recess reduces the weight of the piston cooling nozzle, which is beneficial in the current search for engine performance.

The distance between the axes of the first and second holes of the transverse fixing plate is preferably just sufficient to enable the engagement of a screwing tool over the head of the fixing screw and rotation thereof without coming into contact with the peripheral wall of the nozzle body.

In a first embodiment, the external recess is a flat parallel to the axis of the nozzle body.

In another embodiment, the external recess is a concave cylindrical surface whose axis is parallel to the axis of the nozzle body and coaxial with the axis of the fixing screw. This latter embodiment is particularly suitable for a screwing system in which the screwing tool is the end of a robot arm with a circular cylindrical external contour and an internal contour adapted to grasp the screw head.

BRIEF DESCRIPTION OF THE DRAWINGS

Other objects, features and advantages of the present invention will emerge from the following description of particular embodiments given with reference to the appended drawings, in which.

DESCRIPTION OF THE PREFERRED EMBODIMENTS

Figure 1:
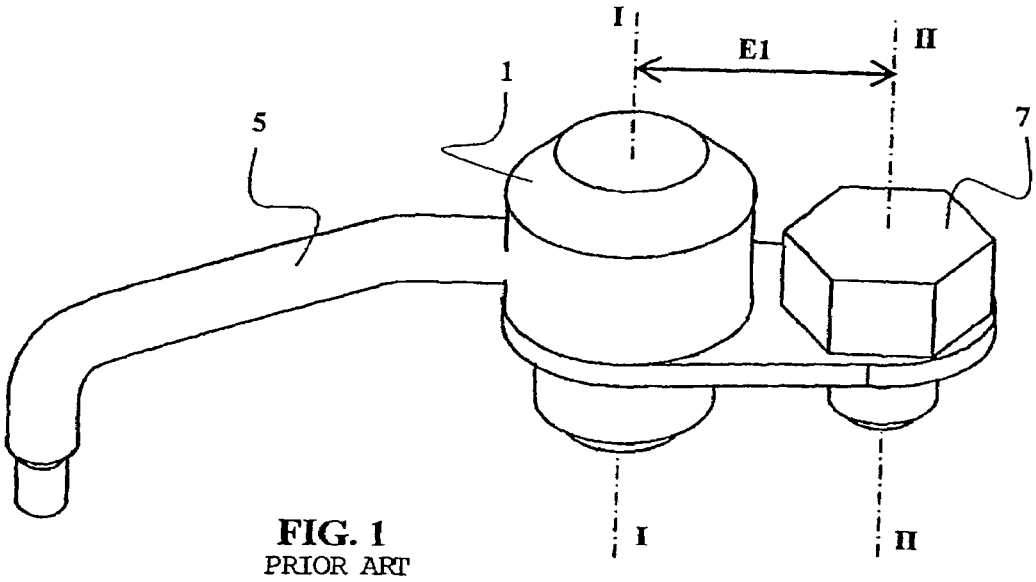
FIG. 1 PRIOR ART
FIG. 1 is a perspective view of a prior art piston cooling nozzle structure, with a relatively large distance between the axis of the nozzle body and the axis of the fixing screw.
Figure 2:
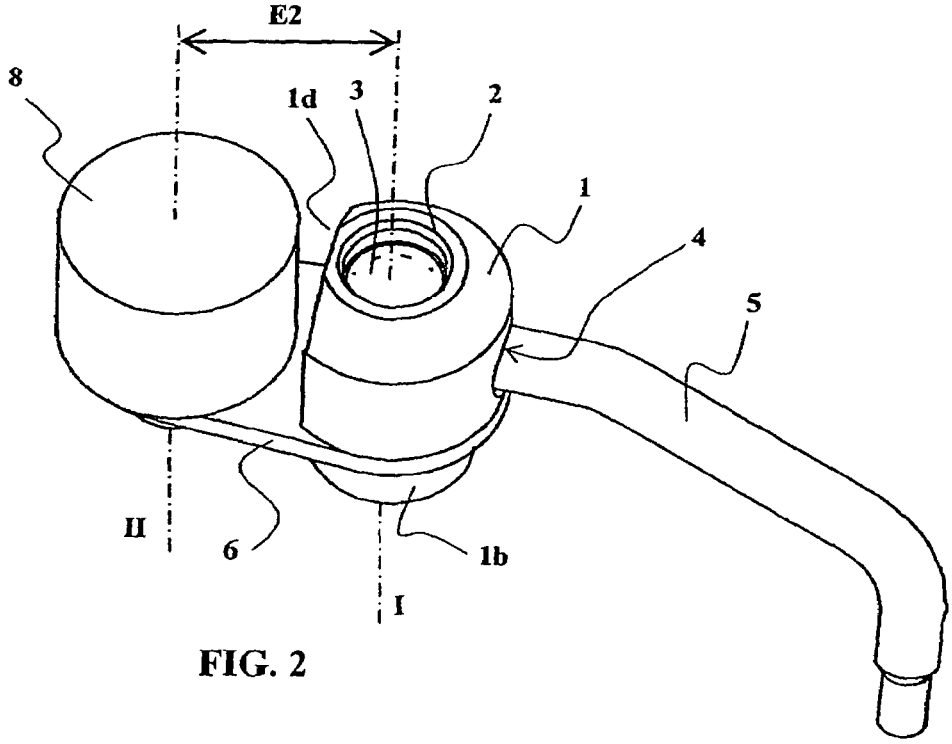
FIG. 2 is a perspective view of a first embodiment of a piston cooling nozzle according to the invention, associated with the tightening head of a robot arm.
Figure 3:
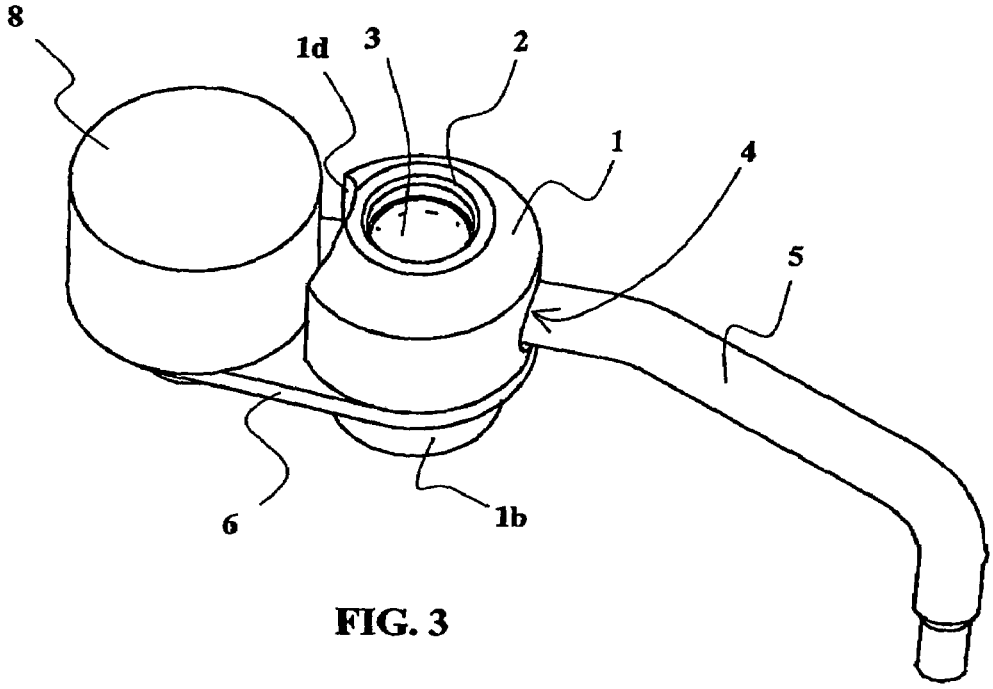
FIG. 3 is a perspective view of a second embodiment of a piston cooling nozzle according to the invention.

In the embodiments of FIGS. 2 and 3, as well as in the prior art embodiment of FIG. 1, the nozzle comprises a nozzle body 1 with a generally cylindrical peripheral wall having an axis I—I and surrounding an axial bore 2 containing valve means 3.

Figure 4:
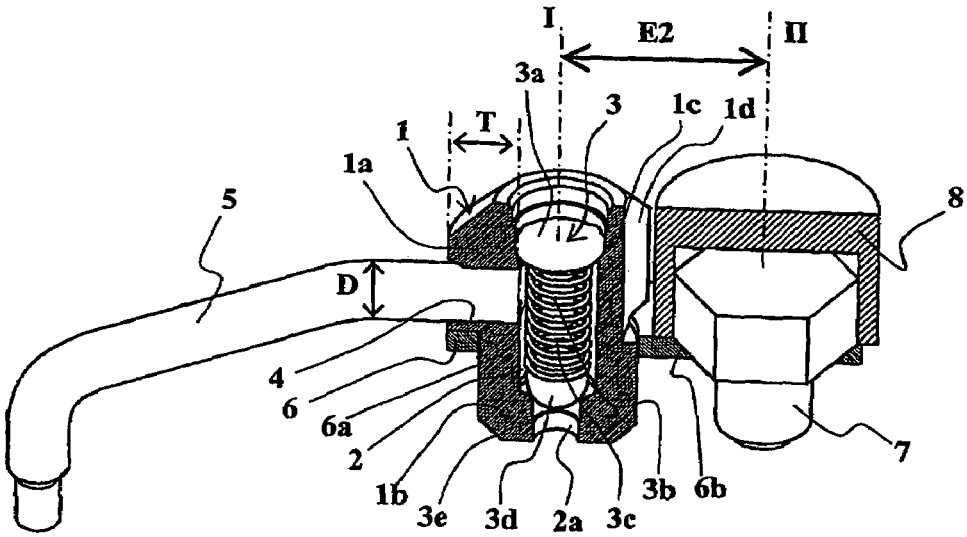
FIG. 4 is a view of the FIG. 3 nozzle in longitudinal section.

As shown in FIG. 4, for example, the valve means 3 comprise a fixing screw 3*a* whose axial shank 3*b* guides a compression spring 3*c* that pushes a closure ball 3*d* against a seat 3*e* of the nozzle body 1. Thus the ball 3*d* may shut off the axial bore 2 as long as the cooling fluid pressure at the inlet 2*a* of the axial bore 2 does not exceed a particular threshold corresponding to the thrust force of the spring 3*b*.

A transverse bore 4 passes through the peripheral wall 1*a* of the nozzle body 1, communicates with the axial bore 2 and is connected to a cooling fluid outlet duct 5.

The nozzle body 1 has a cylindrical inlet portion 1*b* coaxial with the axis I—I, and conformed so that it may be inserted into a fluid feed orifice of the engine cylinder block.

A transverse fixing plate 6 is associated with the nozzle body 1 for fixing it to the engine cylinder block. To this end, the transverse fixing plate 6 includes a first hole 6*a* into which the nozzle body 1 is force-fitted or welded and a laterally offset second hole 6*b* facing the transverse bore 4 through which passes a screw 7 for fixing the nozzle to the engine cylinder block.

As may be seen in FIG. 1, in the prior art embodiments, the distance E1 between the axis I—I of the nozzle body 1 and the axis II—II of the fixing screw 7 must be sufficient to leave a radial clearance between the nozzle body 1 and a screwing tool engaged over the head of the fixing screw 7. This is why the distance E1 between axes must be large, which makes it obligatory to choose the dimensions of the fixing plate 6 accordingly.

Turning now to FIGS. 2 to 4, showing the invention, it is seen that the distance E2 between axes may be small even though a satisfactory thickness of the peripheral wall 1*a* is retained in the areas where this is necessary.

Thus in FIG. 4 it is seen that the peripheral wall 1*a* has a thickness T that is greater than or equal to the diameter D of the transverse bore 4. As a result, the cooling fluid outlet 5 may be an attached tube, with its end force-fitted into the transverse bore 4, which is sufficient to guarantee effective retention of the fluid outlet duct 5.

At the same time, in the diametrally opposite portion of the peripheral wall 1*a*, i.e. in the portion 1*c* opposite the transverse bore 4, the peripheral wall is thinner because of the presence of an external recess 1*d* facing the second hole 6*b* in the transverse fixing plate 6. The thickness of the portion 1*c* of the peripheral wall remains just sufficient in this area to withstand mechanical stresses and the external recess 1*d* enables the axis II—II of the fixing screw 7 to be moved closer.

As shown in FIG. 4, the distance E2 between the axes of the first hole 6*a* and the second hole 6*b* of the transverse fixing plate 6, or the distance between the axes of the nozzle body 1 and the fixing screw 7, is just sufficient to enable the engagement of a screwing tool 8 over the head of the fixing screw 7 and rotation thereof without coming into contact with the peripheral wall 1*a* of the nozzle body 1. A functional clearance is left between the screwing tool 8 and the nozzle body 1 to facilitate the movement of the screwing tool 8 when it is fitted to and removed from the fixing screw 7.

In the embodiment of FIGS. 3 and 4, the external recess 1*d* is a cylindrical concave surface whose axis is parallel to the axis I—I of the nozzle body 1 and coaxial with the axis II—II of the fixing screw 7.

The screwing tool 8 shown is the end of a robot arm with a circular cylindrical external contour and an internal contour adapted to grasp the screw head 7.

In the embodiment shown in FIG. 2, the external recess 1*d* is a flat parallel to the axis I—I of the nozzle body 1.

The present invention is not limited to the embodiments that have been described explicitly and includes variants and generalizations thereof within the scope of the following claims.

What is claimed is:

1. An internal combustion engine piston cooling nozzle comprising:

a nozzle body with a peripheral wall around an axial bore containing valve means, a transverse bore communicating with the axial bore passing through the peripheral wall and being connected to a cooling fluid outlet duct, the nozzle body having a cylindrical inlet portion conformed to be inserted into a fluid feed orifice of an engine cylinder block, and a transverse fixing plate having a first hole into which the nozzle body is fixed, and having a laterally offset second hole opposite the transverse bore for a screw for fixing the nozzle to the engine cylinder block to pass through, in which nozzle:

at least around the transverse bore, the peripheral wall is thick, its thickness being greater than or equal to the diameter of the transverse bore, and the peripheral wall has a thinner portion diametrally opposite the transverse bore because of the presence of an external recess facing the second hole in the transverse fixing plate.

2. The piston cooling nozzle claimed in claim 1, wherein the distance between axes of the first and second holes of the transverse fixing plate is just sufficient to enable the engagement of a screwing tool over a head of the fixing screw and rotation thereof without coming into contact with the peripheral wall of the nozzle body.

3. The piston cooling nozzle claimed in claim 2, wherein the screwing tool is an end of a robot arm with a circular cylindrical external contour and an internal contour adapted to grasp the head of the screw.

4. The piston cooling nozzle claimed in claim 1, wherein the external recess is a flat parallel to an axis of the nozzle body.

5. The piston cooling nozzle claimed in claim 1, wherein the external recess is a concave cylindrical surface having an axis parallel to an axis of the nozzle body and coaxial with an axis of the fixing screw.

* * * * *